United States Patent [19]

Brewer

[11] 4,059,236

[45] Nov. 22, 1977

[54] SHEARING STRUCTURE IN MATERIALS REDUCTION MACHINERY

[75] Inventor: John C. Brewer, Salt Lake City, Utah

[73] Assignee: Garbalizer Corporation of America, Salt Lake City, Utah

[21] Appl. No.: 747,482

[22] Filed: Dec. 6, 1976

[51] Int. Cl.[2] ..... B02C 18/06

[52] U.S. Cl. ..... 241/243; 241/32; 241/292.1

[58] Field of Search ..... 241/32, 190, 243, 292.1, 241/294

[56] References Cited

U.S. PATENT DOCUMENTS

| | | | |
|---|---|---|---|
| 2,841,341 | 7/1958 | Noble et al. | 241/243 |
| 2,842,175 | 7/1958 | Thompson | 241/243 |
| 3,202,369 | 8/1965 | Judd | 241/190 |
| 3,545,686 | 12/1970 | Brown | 241/243 X |
| 3,762,256 | 10/1973 | Frantz | 241/190 X |
| 3,840,187 | 10/1974 | Brewer | 241/294 X |
| 3,874,604 | 4/1975 | Gronberg et al. | 241/292.1 X |

*Primary Examiner*—Roy Lake
*Assistant Examiner*—Howard N. Goldberg

[57] ABSTRACT

Shearing structure for materials' reduction equipment wherein a scissor-type shearing function is preserved, as between the blades and cutter bars used, from an initial shearing position throughout passage of the blade tip toward, at, and past the shearing edge of associated anvil or cutter bar structure. Each blade tip is provided with an apex, the same mating with an apex recess in the cutter bar structure which defines an outermost extremity of the blade travel path through such cutter bar structure.

1 Claim, 6 Drawing Figures

SHEARING STRUCTURE IN MATERIALS REDUCTION MACHINERY

FIELD OF INVENTION

The present invention relates to materials' reduction equipment such as shredders, shearing mechanism, and the like useful in reducing municipal waste, for example, and more particularly, to shredding means incorporating a shearing function throughout the entire length and especially at the tip of each blade means employed. The invention finds special use for structures incorporating plural, mutually-spaced blade means keyed to a revolving shaft, and wherein the blade means cooperates with an anvil or cutter bar structure in accomplishing a shearing function with respect thereto.

DESCRIPTION OF PRIOR ART

In the past, many types of materials reduction machinery have been developed and placed on the market. Such machinery includes any one of several means for reducing materials as, for example, by flaying, see U.S. Pat. Nos. 3,136,556, 3,011,793, by employing a plurality of impact hammers, and by employing blades for shredding material.

In certain prior machines, see the inventor's own U.S. Pat. Nos. 3,708,127 and 3,762,655, the blades keyed to a revolving shaft pass through passageways defined by adjacent cutter bars of a stationary anvil structure. The cutting edges of the cutter bars are disposed in proximity with the sides of each blade, thereby effecting a cutting force in shear as to any material dropped between the blade end and the anvil. As is well known in the art, it takes a hydraulic or mechanical press of a substantial capacity to perform a stamping function as to sheet stock having a thickness of appreciable degree. The passage of a blunt end of a blade materially increases the loading on a blade structure and wear as to the ends of blade shearing portions.

BRIEF SUMMARY OF THE INVENTION

What the present invention provides, therefore, is a blade having an apex, and cooperating cutter bar or anvil structure, wherein the shearing function is preserved throughout the area of shearing cooperation, as between the cutter bars of the anvil and the blades employed. The blades themselves have shearing portions termination in apexes in a plane normal to blade advance. A scissor-type shearing movement of the blade relative to cutter bars, disposed on opposite sides thereof, is preserved and maintained completely to the sharpened end or tip of each blade, so that a scissor-like action is preserved through the entire length of cut. The anvil or cutter bar structure has suitable apex-configured recesses for receiving in proximity the passage of the blade ends therethrough.

Accordingly, a principal object of the present invention is to provide a new and improved cutter blade structure.

A further object is to provide improved shearing structure in materials' reduction machines.

An additional object is to provide, in materials' reduction machinery, for a scissor-type shearing function to be maintained, as between cutter blades and their cooperating cutter bars, to the end of the shearing stroke of each blade.

A further object is to provide revolving blades having sharpened edge extremities and apex-formed recesses in anvil structures, such recesses cooperating with travel path spaces in the anvil structure accommodating revolvement of shearing blades of such structure and passage of the blade extremities through such recesses.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
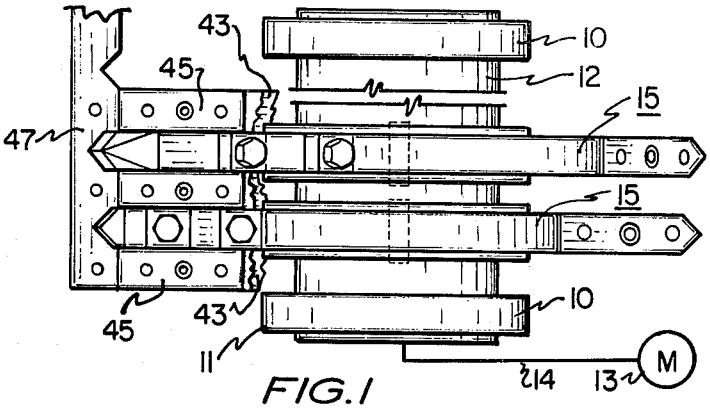
FIG. 1 is a plan view of the structure of FIG. 2 and illustrates in fragmentary form a shredder structure incorporating a rotating shaft having a plurality of shearing blades.
Figure 2:
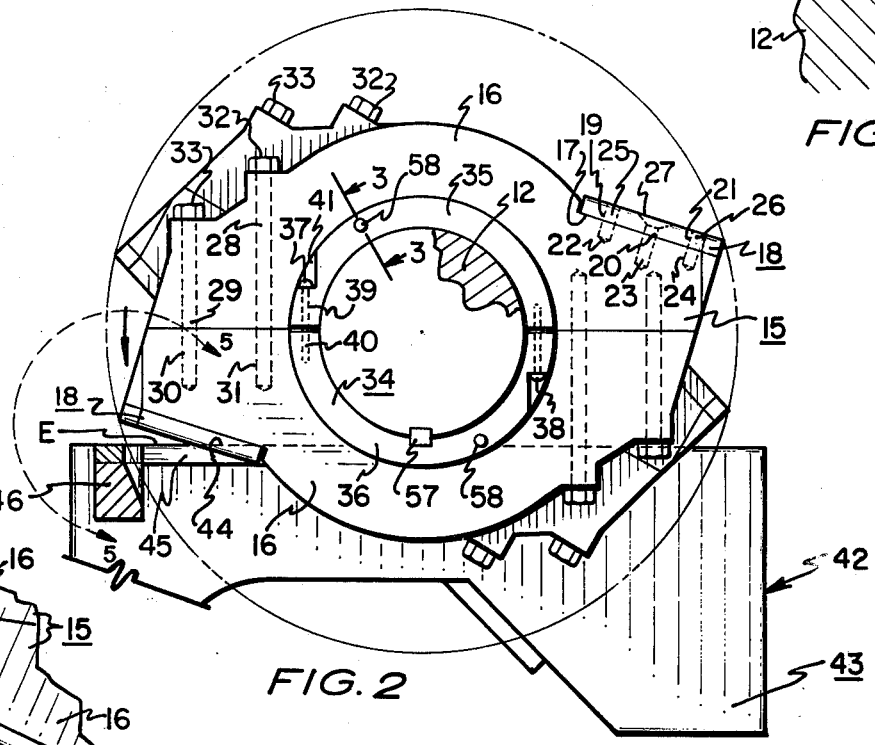
FIG. 2 is a front elevation of the structure in FIG. 1 and, in particular, illustrates a pair of adjacent shearing blades, one behind the other, the same cooperating with a base or anvil structure.

In FIGS. 1 and 2 the bearings 10 and 11 journal shaft 12, and motor 13 is coupled via line 14 to shaft 12 to rotate the same. Mounted upon the shaft 12 are a series of blades 15 which are mutually spaced and also may be rotationally displaced relative to each other such that their shearing portions form essentially the locus of a helix about the shaft axis. Blade 15, as seen in FIG. 2, is composed of plural blade segments 16 which may be similarly structured and each of which includes a seat 17 for receiving hardened blade insert 18. Blade insert 18 includes apertures 19–21 cooperating with blade segment apertures 22–24 for mutual alignment therewith. Pins 25 and 26 are received in aligned apertures 19,22 and 21,24, this in order that the blade insert can be appropriately positioned and maintained by machine screw 27.

The blade segments will each include apertures 28–31 for receiving machine bolts 32,33 in the manner illustrated in FIG. 2.

Mounting each composite blade 15 to shaft 12 is a hub assembly 34 taking the form of a pair of hub segments 35,36 that are secured together by bolts or screws 37,38. Threaded apertures 39,40 and step recess 41 may be provided for this purpose.

The anvil structure 42 includes a series of parallel, mutually aligned crossbars 43 each of which is provided at an upper surface 44 with cutter bar insert 45. Correspondingly, the anvil crossbar 46 will be provided with an end plate insert 47 and will be recessed at 48 for receiving the progressive travel of each blade tip. The blade tip 49 of each blade, see FIG. 4, includes an apex 50 formed by tapered facets or faces 51,52. Each blade insert 18 is preferably hardened steel and includes an outer apex 50' formed by facets 53 and 54.

The combined structure of the end plate insert 47 and the cutter bar inserts 45 form parallel passageways 53 that closely match the size of each blade, allowing perhaps 15 to 20 thousandths of an inch in clearance for blade passage. Of prime importance is the fact that the blade-end-receiving recesses 56 are formed as apexes for receiving the apex 50 of each blade.

If desired, support structure forming part of the anvil 42 may be provided to support transverse crossbar 46.

Figure 3:
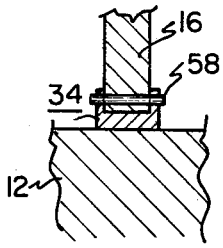
FIG. 3 is an enlarged fragmentary detail, principally in section, and taken along the line 3—3 in FIG. 2.

In assembly, the shaft 12 is first journaled by journal bearings 10 and coupled to motor 13 by any suitable mechanical means for revolvement thereby. The anvil structure 42 will be stationary and in place, and include the several parallel cutter bars with the cutter bar inserts or segments 45, these being replaceable and used for stationary shearing purposes. Key 57 keys each blade 15 to the shaft 12 in a conventional manner. Shear pins 58, having intermediate shear plane grooves as shown, may be provided as seen in FIG. 3.

The crossbar 46 will be supplied with an upper surface, end plate insert 47 that is also replaceable and which may be made up in fact of a series of segments placed end to end. In any event, the segments or the composite end plate insert, as the case may be, will be supplied with apex-shaped recesses for receiving in close proximity the apex 50 of each respective blade as the same passes closely through each apex.

Figure 5:
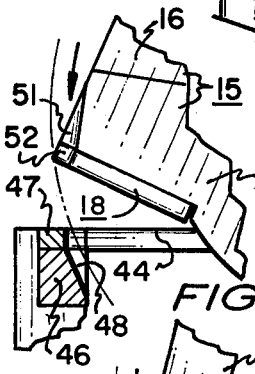
FIG. 5 is a fragmentary view taken along the arcuate line 5—5 in FIG. 2, illustrating the shearing angle at which the blade insert of a particular blade segment approaches the edges of the cutter bars of the anvil.
Figure 6:
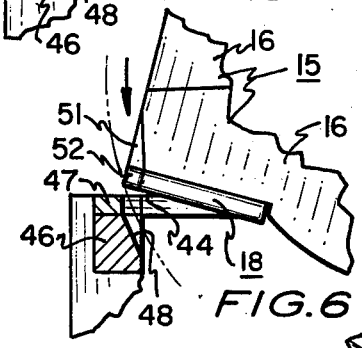
FIG. 6 is similar to FIG. 5, but illustrates a further, counter-clockwise rotational advance of the blade, illustrating that even as a tip approaches and passes through the cutter bar structure a scissor-type shearing action is still taking place.
Figure 4:
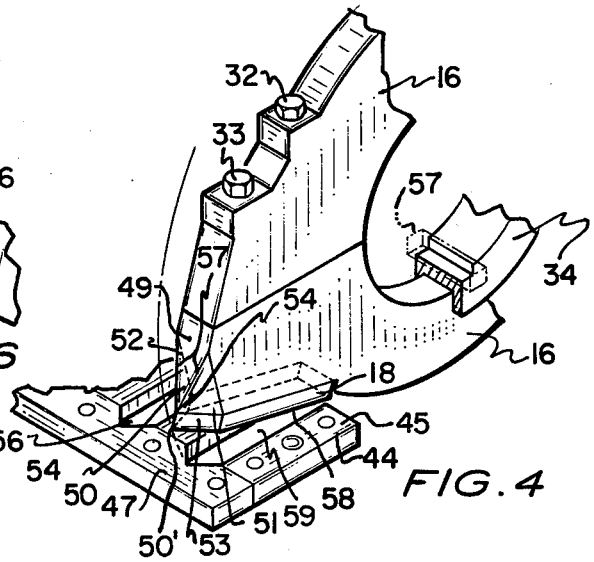
FIG. 4 is a fragmentary perspective view of the shearing blade when the same is approaching a stationary anvil structure to pass through slots or passageways therein.

FIGS. 4 and 5 illustrate that the shearing angle, e.g. 16° 30', is maintained between each blade insert 18 and its edges, and the cooperating edges of the cutter bar inserts 45 and even the end plate insert 47. Thus, a scissor-type shearing action is instituted, maintained, and preserved throughout the entire passage of each blade cutting edge throughout the latter's traverse into elongate, rectilinear slot or slot passageway 59 and past each cutter bar cutting edge E, see FIG. 2. This is even maintained as the tip passes closely adjacent surface 48 in FIG. 6. Accordingly, a blunt edge "square-end" stamping effect is precluded from occurring at the outer end of the blade, this by virtue of the blade's contour to a sharpened tip. Kindly note, as to blade inserts 18, and that their facets or faces 53,54 form a pointed, sharp tip 50' and thus maintain a scissor-type shearing relationship with a respective side of the wedge-shaped, blade-end receiving recesses 56.

For machinery purposes it is best that the structure of FIG. 4 be preserved as indicated. If desired, however, the angle at 57 may be formed such that it is straight-sided and terminates at the portion of the tip 50' which is disposed at lower surface or elongate shearing edge 58 of insert 18.

The blades insert, of course, can be made reversible, as well as the inserts of the anvil or cutter bar structure. Each of the blade inserts define, of course, a blade shearing portion disposed at one or more places relative to each plate. The locus of the upper surfaces 44 of each cutter bar defines the anvil structure reaction surface or plane with which the blades function.

Though the drawings indicate a preferred embodiment, other and equivalent modifcations may be made in the actual structure selected.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. In combination, an anvil structure provided with blade travel passageways comprising elongate, rectilinear, mutually parallel slots terminating in outer extremity apexes, a shaft, and plural blades mounted upon said shaft, registered with said passageways for travel therethrough, and having elongate shearing portions aligned with and entering said slots and provided with apex-configured ends registering with said passageways proximate said slot extremity apexes, and wherein said anvil structure has an upper reaction surface, said blades having elongate shearing portions constructed to pass in angulated, scissor-type shear, beginning nearest said shaft, relative to said upper reaction surface of said anvil structure.

* * * * *